US010186799B2

(12) United States Patent
Clements et al.

(10) Patent No.: US 10,186,799 B2
(45) Date of Patent: Jan. 22, 2019

(54) ELECTRICAL CONNECTORS HAVING FIELD SHAPING RINGS

(71) Applicant: The Boeing Company, Chicago, IL (US)

(72) Inventors: Kelton Ray Clements, Berkeley, MO (US); Timothy Mark Fleeger, Saint Louis, MO (US)

(73) Assignee: The Boeing Company, Chicago, IL (US)

( * ) Notice: Subject to any disclaimer, the term of this patent is extended or adjusted under 35 U.S.C. 154(b) by 145 days.

(21) Appl. No.: 15/438,342

(22) Filed: Feb. 21, 2017

(65) Prior Publication Data

US 2018/0241145 A1 Aug. 23, 2018

(51) Int. Cl.
*H01R 13/53* (2006.01)
*H01R 13/405* (2006.01)
*H01R 43/24* (2006.01)

(52) U.S. Cl.
CPC ..... *H01R 13/53* (2013.01); *H01R 13/405* (2013.01); *H01R 43/24* (2013.01)

(58) Field of Classification Search
CPC ..... H01R 13/53
See application file for complete search history.

(56) References Cited

U.S. PATENT DOCUMENTS 3,499,099 A 3/1970 Nicholson
3,816,639 A * 6/1974 Anderson ..... H02G 15/003 174/73.1
4,203,641 A * 5/1980 Siebens ..... H01R 13/53 439/339
5,460,544 A * 10/1995 Inaba ..... H01R 13/53 439/578
6,332,785 B1 * 12/2001 Muench, Jr. ..... H01R 13/53 439/88
7,066,739 B2 * 6/2006 McLeish ..... H01R 13/6205 439/39
7,311,566 B2 * 12/2007 Dent ..... H01R 13/187 439/63
7,717,739 B2 * 5/2010 Hawkins ..... H01R 31/06 439/503
8,641,434 B2 * 2/2014 Siebens ..... H01R 13/53 439/181
2004/0028184 A1 * 2/2004 Hansen ..... H01R 33/7678 378/123
2008/0261465 A1 * 10/2008 Hughes ..... H01R 13/187 439/889
2009/0211089 A1 * 8/2009 Hughes ..... H01R 31/08 29/883
2012/0156934 A1 * 6/2012 Lee ..... H01R 13/53 439/625
2018/0241145 A1 * 8/2018 Clements ..... H01R 13/405

FOREIGN PATENT DOCUMENTS

EP 0688075 12/1995

* cited by examiner

*Primary Examiner* — James Harvey
(74) *Attorney, Agent, or Firm* — Hanley, Flight and Zimmerman, LLC

(57) ABSTRACT

Electrical connectors having field shaping rings are disclosed. A disclosed example apparatus includes a body of a connector, where the body has a longitudinal axis, an electrical conductor extending substantially parallel to the longitudinal axis and within the body, and an annular electrode embedded within the body.

25 Claims, 7 Drawing Sheets

ELECTRICAL CONNECTORS HAVING FIELD SHAPING RINGS

FIELD OF THE DISCLOSURE

This disclosure relates generally to electrical connectors and, more particularly, to electrical connectors having field shaping rings.

BACKGROUND

Matably couplable electrical contact systems generally consist of a connector pair that includes a plug and a corresponding receptacle. Such connector pairs are typically used to define an electrical pathway through which current may flow, thereby electrically coupling devices to one another. Connector pairs used in high voltage applications, for example, may be susceptible to dielectric breakdown caused by connector components that have imperfections, impurities and/or significant material differences, all of which can result in unintended current flow, arcing, electrical shorts and/or connector damage.

SUMMARY

An example apparatus includes a body of a connector, where the body has a longitudinal axis, an electrical conductor extending substantially parallel to the longitudinal axis and within the body, and an annular electrode embedded within the body.

An example method of producing a connector includes placing an electrical conductor within a body of the connector, where the electrical conductor is to extend along a longitudinal length of the body, and defining an annular electrode embedded within or surrounding the body.

Another example apparatus includes a body of a connector, where the body has an electrical conductor extending therethrough along a longitudinal axis of the body, and an annular electrode surrounding an outer surface of the body.

An example method includes applying a voltage to at least one of first and second connectors that are matably coupled, where the first connector includes a connector body, and where an annular electrode is embedded within or surrounding the connector body.

Figure 2:
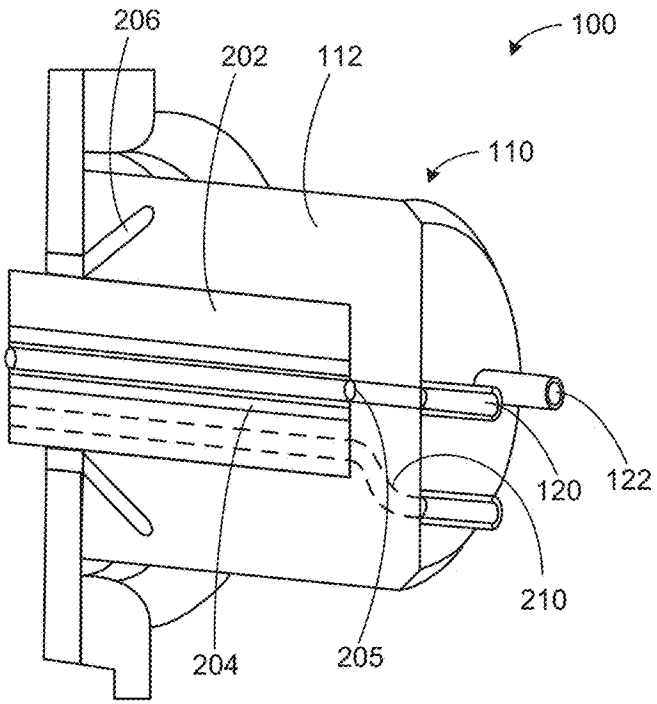
FIG. 2 (PRIOR ART)
FIG. 2 is cross-sectional view of the known connector of FIG. 1.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part is in any way positioned on (e.g., located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Electrical connectors having electric field shaping rings are disclosed. Typical connector systems (e.g., connector pairs) used in high-voltage applications are sometimes susceptible to shorting and/or connector damage due to dielectric breakdown, which can negatively impact reliability or performance. For example, material or processing defects/imperfections such as cracks or voids present on an internal or external component of a connector may allow current to arc within the connector and, thus, adversely affect performance of the connector or electrical devices or equipment utilizing the connector as an electrical current path. Such imperfections can result from manufacturing defects and/or improper handling of connector components and/or the connector.

The examples disclosed herein reduce and/or eliminate the probability of dielectric breakdown of a connector and/or a connector interface by altering a voltage gradient or electric field distribution or shape, thereby significantly improving connector performance and reliability. The examples disclosed herein also enable less expensive materials and/or reduced material volume/weight to be used for insulation that is typically required to minimize occurrences of electrical shorts. As a result, component, material and/or manufacturing costs may be reduced, thereby enabling relatively compact connector designs.

The examples disclosed herein utilize an electrode (e.g., an electrode ring) that may be embedded in a body of a connector (e.g., a plug or a receptacle) to vary a voltage gradient of an electric field of the connector, thereby reducing a probability of dielectric breakdown, arcing and/or connector degradation. In particular, the electrode may be provided with voltage, but without a current path (e.g., the electrode is electrically isolated and, thus, floats at the provided voltage without current flow). In other examples, an electrode may at least partially surround an external surface of a body of a connector to vary an electric field within the body of the connector.

In some examples, the electrode exhibits a generally toroidal and/or annular shape. In some examples, the electrode has a substantially round, curved and/or circular profile or cross-section. In some examples, the electrode is electrically coupled to a connector contact. In some examples, the body is over-molded onto the electrode (e.g., over-molding the body over the electrode). In yet other examples, the electrode is molded and/or cast into the body.

As used herein, the term "connector" refers to a connector side/portion (e.g., a plug, a receptacle, etc.), a mated connector pair, a connector system and/or a connector assembly, etc. As used herein, the term "conductor" or the term "electrical conductor" refers to a wire, a contact, solder bridge, etc. As used herein, the terms "ring" and "annular" refer to a circular and/or elliptical geometry, as well as any geometry that surrounds or encompasses another an object and/or geometric feature (e.g., a body, a plane, an axis, etc.).

Accordingly, the terms "ring" or "annular" may refer to non-circular or non-round surrounding/enclosing shapes (e.g., a surrounding rectangular perimeter, a surrounding triangular perimeter, etc.). Further, the terms "ring" or "annular" refer to a closed loop, or a partially open loop. As used herein, the term "embedded" refers to a first object being placed within a second object such that the second object surrounds features and/or geometry of the first object (e.g., surrounds and envelopes outer features of the first object, the second object extends within portions of the first object, etc.).

Figure 1:
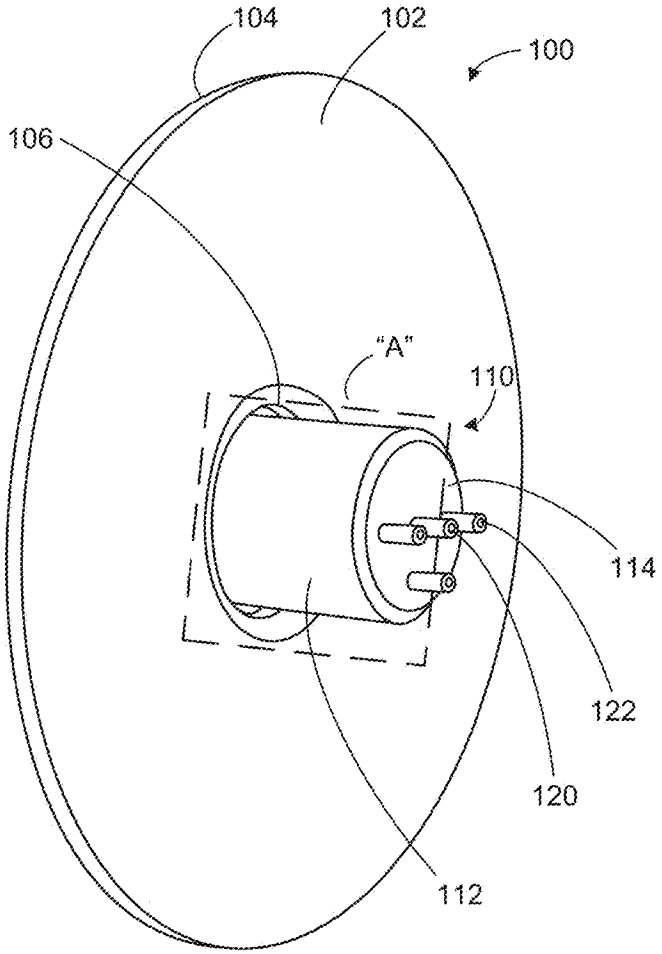
FIG. 1 (PRIOR ART)
FIG. 1 illustrates a known connector.

FIG. 1 illustrates a known connector (e.g., a connector plug) 100. The connector 100 includes a flange 102 with a peripheral edge 104 an opening 106, and a body 110 that extends through the opening 106. The body 110 of the illustrated example includes a cylindrical portion 112 and a face portion 114. In this example, a central contact (e.g., a center pin) 120 as well as surrounding contacts (e.g., surrounding pins) 122 extend from the face portion 114.

FIG. 2 is cross-sectional view of the known connector 100 of FIG. 1 taken along a plane "A" (shown in FIG. 1) that extends along a central axis of the body 110. According to the illustrated example, a wire (e.g., an insulated wire, a jacketed wire, embedded wire, etc.) 202 extends along a longitudinal length of the cylindrical portion 112, but does not extend to the face portion 114. The wire 202 of the illustrated example includes an inner sleeve 204 having an inner conductor (e.g., a center conductor) 205. In some examples, a ground cone (e.g., exposed insulation, a grounding cone, etc.) 206 is disposed within the cylindrical portion 112. The inner conductor 205 is electrically coupled (e.g., terminated) to the center contact 120. Likewise, other conductors 210, which are at least partially disposed within the sleeve 204, extend along the longitudinal length of the cylindrical portion 112 and are electrically coupled to (e.g., terminated to) respective ones of the surrounding outer contacts 122.

Figure 3:
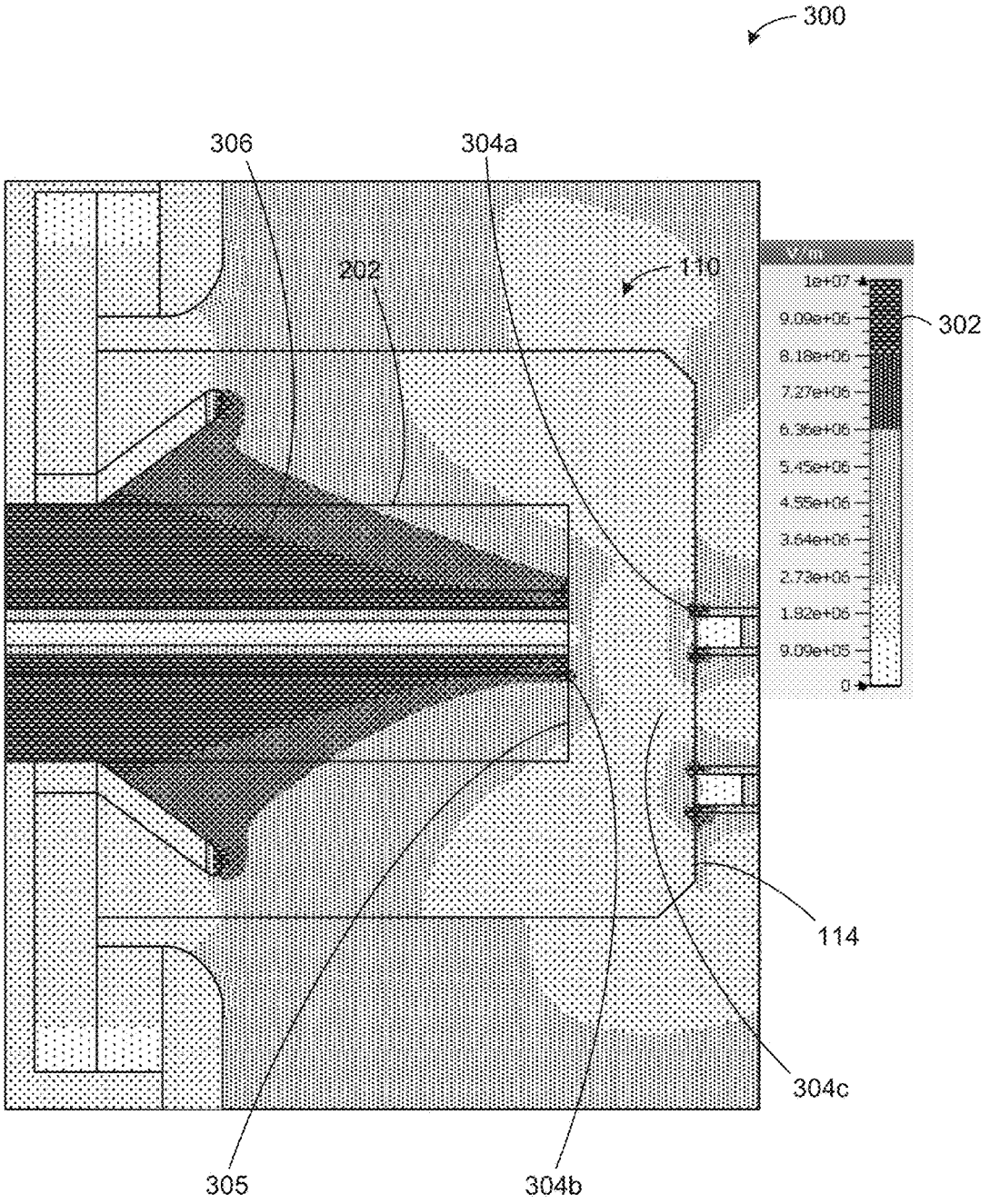
FIG. 3 (PRIOR ART)
FIG. 3 is a graph depicting an electric field corresponding to the known connector shown in FIGS. 1 and 2.

FIG. 3 depicts an electric field graph 300 corresponding to the known connector 100 shown in FIGS. 1 and 2. The electric field graph 300 includes a legend 302 to indicate relative voltage/length along the plane "A" shown in FIG. 1 during operation of the connector 100 (e.g., when a voltage is applied to the connector 100 and/or a current flows therethrough, etc.).

As can be seen by regions 304*a*, 304*b*, 304*c* of the illustrated view, the face portion 114 as well regions near a distal end 305 of the wire 202 exhibit relatively high voltage(s) and/or voltage gradients, which may be caused by dielectric material differences experienced at the distal end 305 of the wire 202. For example, voltage gradients may result from different materials (e.g., wiring, components, insulators, etc.) being placed in close proximity to one another. These voltage gradients may cause dielectric breakdown that results in shorting and/or electrical arcing. Further, imperfections, which may result from manufacturing, material imperfections (e.g., cracks, voids, etc.) and/or processing, in the body 110 and/or the wire 202 may also cause the shorting or arcing. As a result, the body 110, components that are electrically coupled at either mating end/side of the connector 100 and/or a corresponding mating portion (e.g., a corresponding mating connector, a mating electrical contact, etc.) may experience significant damage. Even further, a high voltage and/or high voltage gradient region 306 is also seen in the graph 300 extending along a significant portion of the length of the wire 202, thereby defining additional potential regions of dielectric breakdown.

Figure 4:
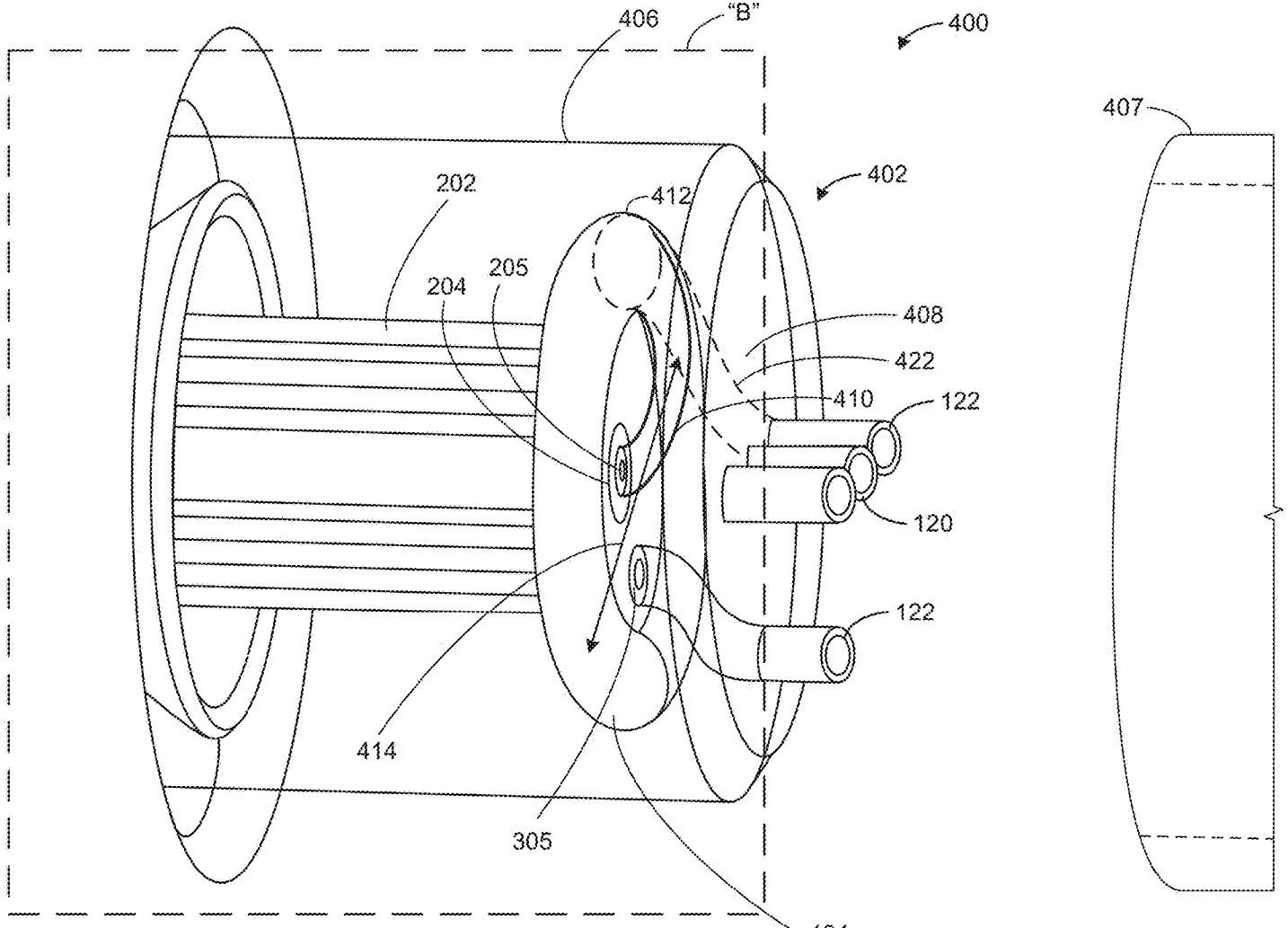
FIG. 4 illustrates an example connector in accordance with the teachings of this disclosure.

FIG. 4 illustrates an example connector 400 in accordance with the teachings of this disclosure. The view of FIG. 4 is shown as partially transparent for clarity. The connector 400 of the illustrated example includes a body 402 having the wire 202 including the inner conductor 205 disposed within, and an electrode (e.g., an electrode ring) 404. The wire 202 and the electrode 404 are both embedded (e.g., encased, surrounded, etc.) within a cylindrical portion (e.g., a cylindrical body portion, a cylindrical section) 406 of the body 402. According to the illustrated example of FIG. 4, a corresponding mating connector (e.g., a receptacle) 407 is shown.

The example body 402 also includes a front face portion (e.g., a mating end) 408 from which the center contact 120 as well as the surrounding contacts 122 described above in FIGS. 1 and 2 extend. The inner conductor 205 may extend out of the inner sleeve 204 to be terminated to the center contact 120, for example. As a result, the inner conductor 205 forms an electrical coupling (e.g., a current path) with a corresponding mating portion (e.g., a receptacle, a corresponding receptacle) and/or electrical device to which the connector 400 is coupled when the connector 400 is mated to the corresponding mating portion. According to the illustrated example, the electrode 404 is electrically coupled and/or terminated to an internal conductor (e.g., an internal wire, an internal contact, etc.) 410 that extends from the inner conductor 205.

The example electrode 404 exhibits a generally toroidal ring shape (e.g., an annular shape). In particular, the electrode 404 exhibits a generally curved (e.g., round, circular, oval-like, elliptical, etc.) cross-sectional profile 412. The annular ring shape of the electrode 404 has a corresponding diameter 414 (e.g., a center-to-center diameter) that surrounds a longitudinal axis defined by the wire 202. In some examples, the diameter 414 is centered on the inner conductor 205 and/or a center axis of the body 402. Additionally or alternatively, the electrode 404 may encircle an outer surface or diameter of the wire 202. In other examples, the electrode 404 may surround other conductors instead of the inner conductor 205.

In this example, the electrode 404 is positioned proximate the front face portion 408, but past the distal end 305 of the wire 202 along a longitudinal length of the body 402. In some examples, the electrode 404 is positioned past the distal end 305 of the wire 202 and closer to the front face portion 408. In other examples, the electrode 404 surrounds the wire 202 on a portion of the wire 202 spaced away from the distal end 305.

As mentioned above, the electrode 404 of the illustrated example is electrically coupled to the internal conductor 410. In particular, the internal conductor 410 is, in turn, electrically coupled to a voltage source (e.g., an alternating-current (AC) voltage source, a direct current (DC) voltage source, a pulsed source, etc.) via the inner conductor 205. However, in this example, the electrode 404 is not electrically coupled to a mating connector and/or corresponding device. In other words, the electrode 404 of the illustrated example does not provide a current path between the connector 400 and its respective mating connector. In some examples, a contact from a corresponding mating connector is electrically coupled to the electrode 404 instead of the internal conductor 410. In these examples, this contact may extend through an aperture of the body 402 to electrically couple the electrode 404 when the corresponding mating connector is coupled to the connector 400.

In some examples, the electrode 404 may be composed of copper, aluminum, brass, steel and/or stainless steel, or any other appropriate material. In some examples, the body 402 is over-molded around and/or at least partially surrounding the electrode 404. In some examples, the electrode 404 is molded or cast within the body 402. Additionally or alternatively, the body 402 includes potting material and/or a dielectric material that surrounds the electrode 404. In some examples, the potting material surrounding the electrode 404 is shaped as an annular band surrounding the electrode 404. In some examples, multiple electrodes are positioned in (e.g., embedded within, at least partially disposed in) the body 402.

While the body 402 of the illustrated example is shown having a generally circular and/or round cross-sectional profile that is defined by the cylindrical portion 406, the body 402 may have an appropriate profile shape including, but not limited to, a square profile, a rectangular profile, a pentagonal profile, a hexagonal profile, etc. While the connector 400 is generally shown in the illustrated example as a plug, any of the features and/or components may be applied to a receptacle or other connector configurations as well (e.g., complementary or mating connectors). Further, while the electrode 404 is shown as having a generally toroid-like structure, the electrode 404 may exhibit any geometry including any polygonal shape, or any other appropriate shape. While the electrode 404 is shown both mechanically and electrically coupled to the internal conductor 410 in this example, in other examples, the electrode 404 is not electrically coupled to any contact or conductor and, thus, is configured as a physically floating (e.g., electrically isolated) electrode (e.g., the electrode 404 is placed within the body 402 without any electrical coupling attached thereto). In some examples, the electrode 404 is electrically coupled to both the internal conductor 410 and the contact 120.

Figure 5:
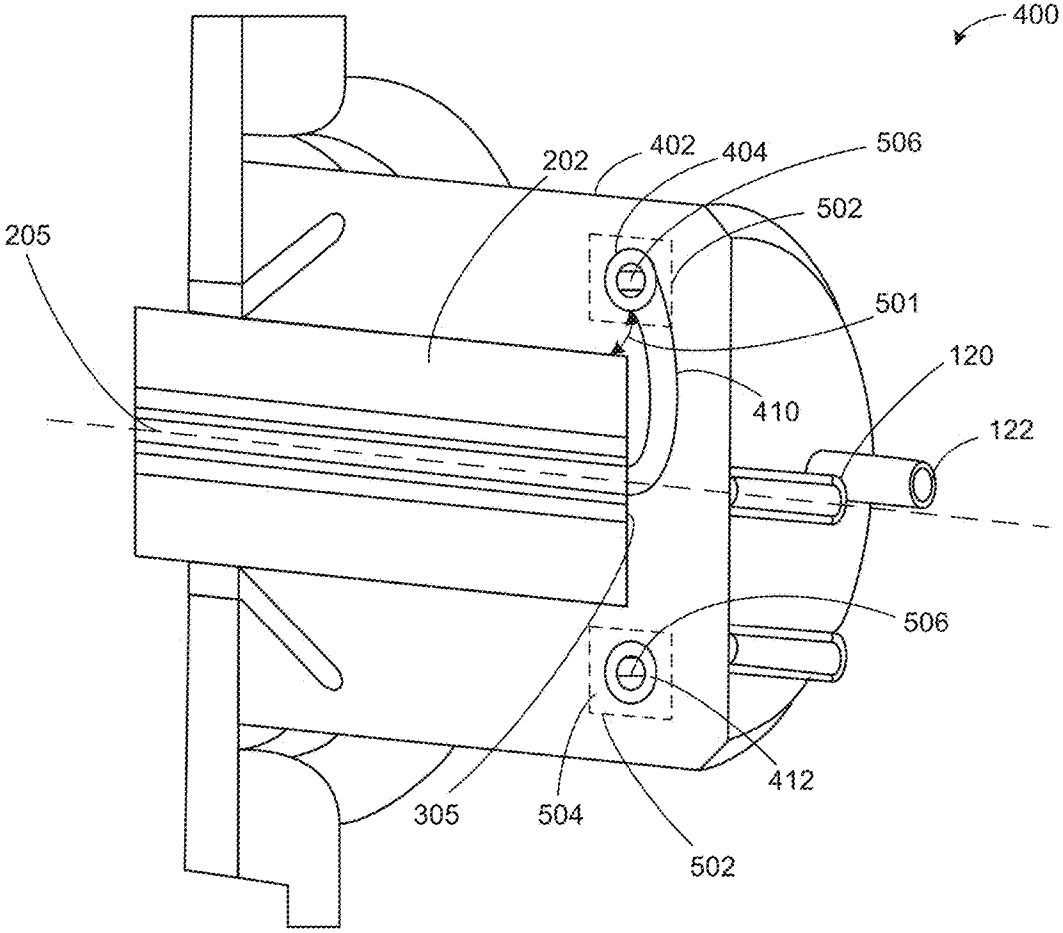
FIG. 5 is detailed cross-sectional view of the example connector of FIG. 4.

FIG. 5 is detailed cross-sectional view of the example connector 400 taken along the plane "B" (shown in FIG. 4). As can be seen in the illustrated view of FIG. 5, an inner diameter of the electrode 404 is sized to define a gap (e.g., a material gap) 501 between the electrode 404 and the wire 202. In this example, the electrode 404 is proximate the distal end 305 of the wire 202. In some examples, a center of the cross-sectional profile 412 (e.g., a geometric center of the cross-sectional profile 412) may be substantially aligned to the distal end 305 of the wire 202.

To vary a voltage distribution or an electric field of the connector 400 and/or a corresponding mated connector, a voltage is applied to the electrode 404. In particular, the internal conductor 410 of the illustrated example provides voltage to the electrode 404, thereby altering an electric field distribution of the connector 400. In other words, a voltage gradient of the electric field is reduced in proximity to the electrode 404, thereby shifting high voltage gradients away from points and/or portions of the body 402 that may be susceptible to shorts and/or arcing and, thus, reducing chances of degrading performance of the connector 400 and/or any corresponding device(s) coupled thereto. In this example, the electrode 404 is not electrically coupled to another electrode or electrical path and, as a result, a significant amount of current does not flow through (e.g., no current flows through) the electrode 404. In some other examples in which the electrode 404 is not electrically coupled to the internal conductor 410 and/or the inner conductor 205, the electric field or voltage gradient may be reduced in proximity to the electrode 404 without voltage being applied to the electrode 404.

In some examples, an electrical path (e.g., a wire) to the electrode 404 extends along a longitudinal length of the body 402. Additionally or alternatively, the electrical path may extend away from the wire 202 along a substantially radial direction of the body 402 and at an intermediate portion of the wire 202 instead of the distal end 305. In some other examples, the electrode 404 is electrically coupled to one of the surrounding contacts 122 via an internal conductor 522. In some examples, potting 502 surrounds (e.g., fully surrounds) the electrode 404 in an annular manner based on filling an annular potting cavity 504. Additionally or alternatively, at least a distal portion or section of the body 402 is at least partially composed of potting and/or a dielectric material. In some examples, the electrode 404 is at least partially hollow and/or contains a void 506 within to reduce weight of the electrode 404, thereby reducing an overall weight of the connector 400 (e.g., for weight reductions in applications such as aircraft).

Figure 6:
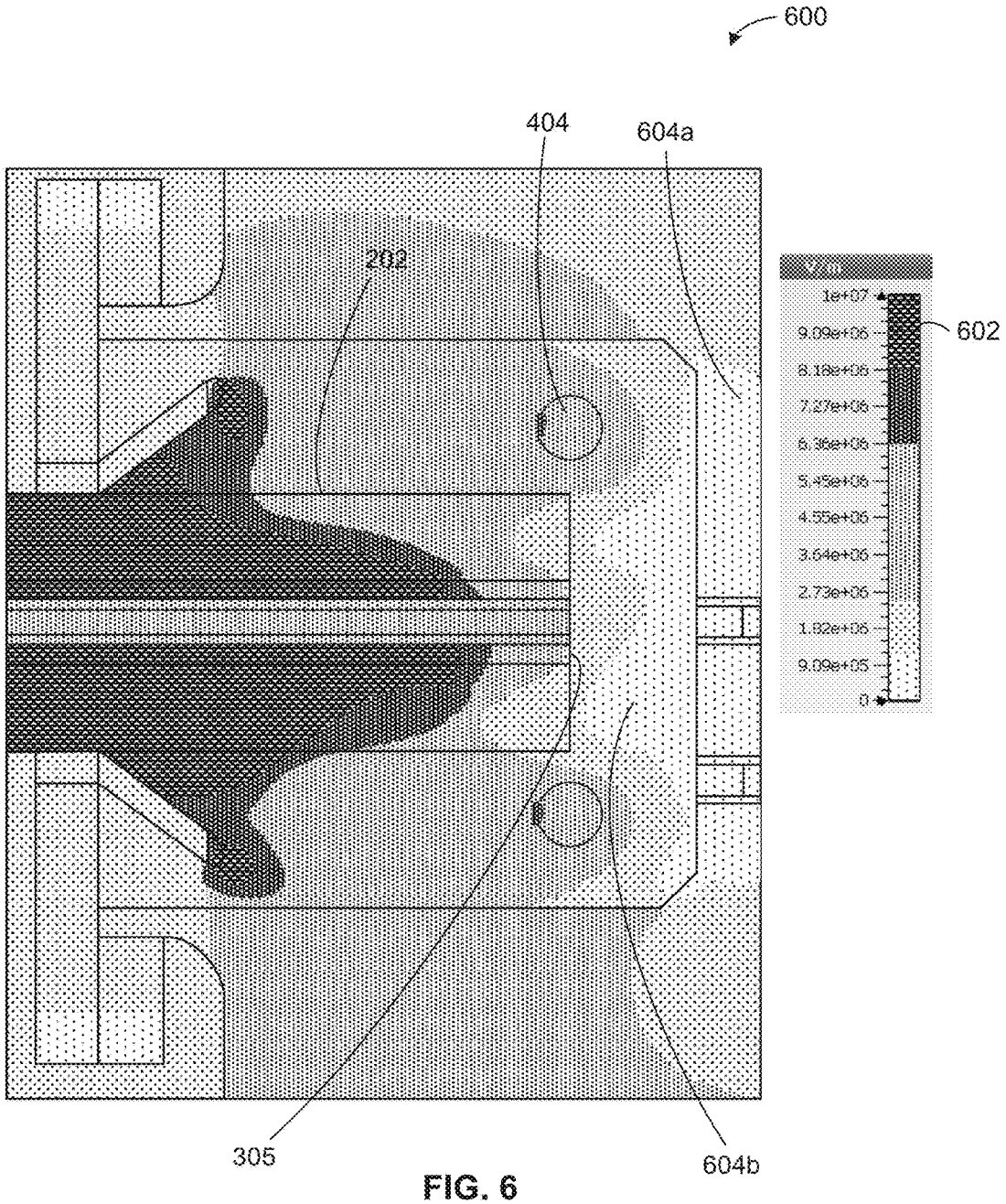
FIG. 6 is a graph depicting an electric field corresponding to the example connector shown in FIGS. 4 and 5.

FIG. 6 depicts an electric field graph 600 corresponding to the example connector 400 shown in FIGS. 4 and 5. The electric field graph 600 includes a corresponding legend 602. In contrast to the electric field graph 300 shown in FIG. 3, the voltage gradient corresponding to the electric field of regions 604*a*, 604*b* as well as near the distal end 305 of the wire 202 has been significantly reduced by the electrode 404. As a result, the potential for unintended electrical current flow such as shorting or arcing is greatly reduced in comparison to the known connector 100.

Figure 7:
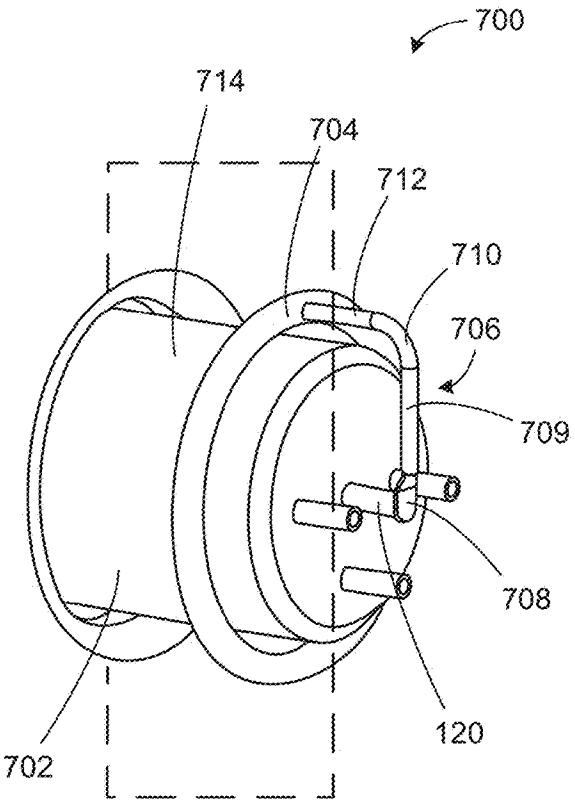
FIG. 7 illustrates an alternative example connector in accordance with the teachings of this disclosure.

FIG. 7 illustrates another example connector 700 in accordance with the teachings of this disclosure. According to the illustrated example of FIG. 7, the connector 700 includes a body 702, an electrode (e.g., an electrode ring) 704 and an electrical coupling (e.g., a wire, a contoured conductor, etc.) 706, which includes a connection 708, a first branch 709, an elbow or bend 710 and a second branch 712 to which the electrode 704 is mechanically and electrically coupled.

Similar to the electrode 404, the electrode 704 exhibits a generally annular toroidal shape but, instead, surrounds an outer diameter and/or external surface 714 of the body 702. As a result, voltage applied to the electrode 704 (e.g., without a current path) provides field shaping in a similar manner to that of the electrode 404 described above in connection with FIGS. 4-6.

In some examples, the electrode 704 forms part of a corresponding mating connector instead of the connector 700. In particular, the electrode 704 may be part of a corresponding plug (e.g., the electrode 704 may be embedded in the corresponding plug) that mates with the connector 700, for example. In such examples, the connection 708 may be a contact that mates with the contact 120. In other examples, the electrode connection 708 may be mechanically coupled to the contact 120 such that a geometry of a corresponding mating connector interlocks, avoids and/or interfaces with the first branch 709, the elbow 710 and/or the second branch 712. In other words, this corresponding mating connector may be geometrically configured and/or keyed to the electrical coupling 706, for example.

Figure 8:
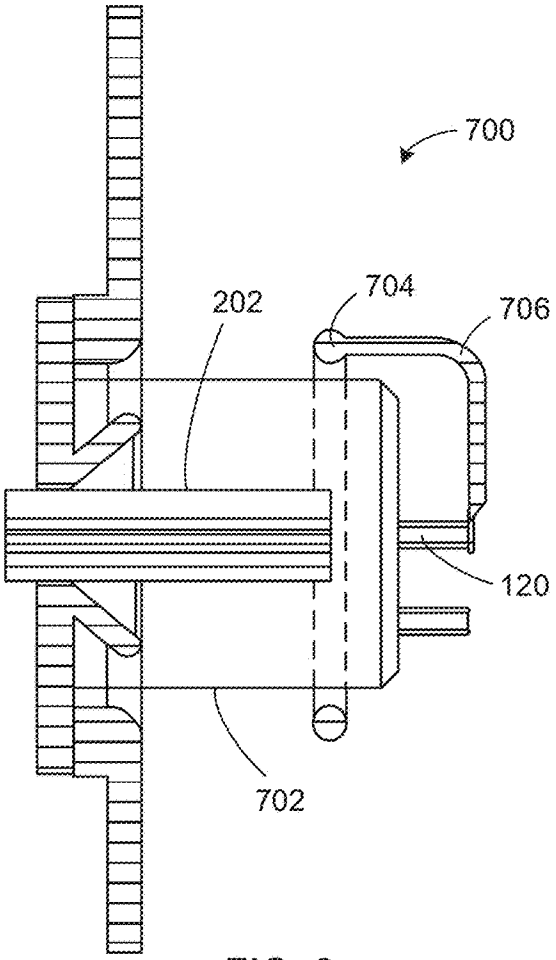
FIG. 8 is detailed cross-sectional view of the example connector of FIG. 7.

Turning to FIG. 8, which is a detailed cross-sectional view of the example connector 700 taken along a plane "C" (shown in FIG. 7), the connector 700 is shown having the example wire 202 disposed within the body 702. According to the illustrated example, the electrical coupling 706 positions the electrode 704 proximate a distal end of the wire 202.

According to the illustrated example of FIG. 8, a voltage is applied from the center contact 120 to the electrode 704, thereby altering an electric field encountered by the connector 700. As a result, a probability of a dielectric breakdown of the connector 700 is greatly reduced. In other examples, the electrical coupling 706 is not coupled to the center contact 120 and may, instead, be coupled to another contact (e.g., a surrounding contact) instead. Alternatively, the electrical coupling 706 may extend through the body 702 in a radial direction.

Figure 9:
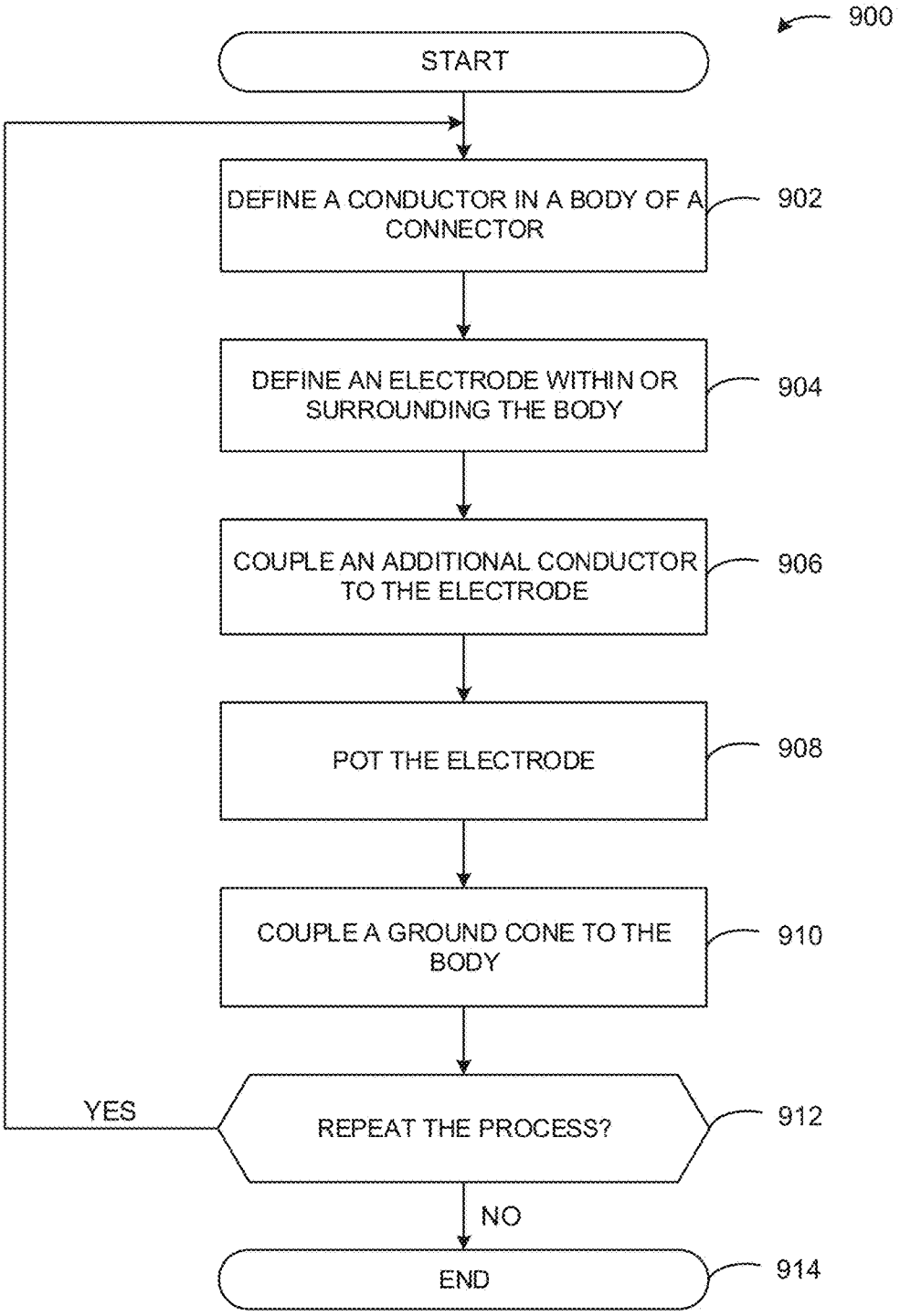
FIG. 9 is a flowchart representative of an example method to produce the examples disclosed herein.

FIG. 9 is a flowchart representative of an example method 900 to produce the examples disclosed herein. In this example, a connector having a body with an embedded electrode is to be produced. In this example, the body has already been produced and will undergo an assembly process.

A conductor such as the inner conductor 205 is defined in the body (block 902). In particular, the conductor is slid through an opening or aperture that extends longitudinally along the body.

The electrode is defined within or surrounding the body (block 904). In this example, the electrode is assembled to and/or placed within the body. In some examples, the electrode is molded or cast within/into the body. Alternatively, in some other examples, the electrode is over-molded to define the body surrounding the electrode.

In this example, an additional conductor is coupled to the electrode (block 906). In some examples, this additional conductor is coupled to the electrode prior to the electrode being defined in or assembled to the body.

In some examples, the electrode is potted (block 908). For example, the body itself may be at least partially composed of a potting material. Alternatively, a potting cavity at last partially surrounding the electrode is filled with the potting material.

In some examples, a ground cone (e.g., the ground cone 206) is coupled to the body (block 910). In some examples, the ground cone is molded onto the body. Additionally or alternatively, the ground cone is assembled to the body. In some examples, the ground cone is defined by a wire embedded within the body.

It is then determined whether the process is to be repeated (block 912). If the process is to be repeated (block 912), control of the process returns to block 902. Otherwise, the process ends. This determination may be based on whether additional electrodes or contacts are to be added to the body.

An example method includes applying a voltage to at least one of first and second connectors that are matably coupled, where the first connector include a connector body, and where an annular electrode is embedded within or surrounding the connector body. In some examples, the method further includes coupling the first and second connectors together. In some examples, applying the voltage includes applying the voltage to the annular electrode. In some examples, the annular electrode is electrically isolated from the second connector. In some examples, the annular electrode is electrically isolated from the first connector.

From the foregoing, it will be appreciated that the above disclosed methods, apparatus and articles of manufacture enable a connection and/or connection point that is highly resistant to arcing, dielectric breakdown and/or unintended electrical contact, thereby significantly improving connector performance. The examples disclosed herein also enable more compact connector designs (e.g., for high-voltage connector applications).

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent. While the example disclosed herein are generally shown in conjunction with electrical connectors, the examples disclosed herein may be applied to any appropriate electrical and/or signal coupling/connection systems.

What is claimed is:

1. An apparatus comprising:

a body of a connector, the body having a longitudinal axis;

an electrical conductor extending parallel to the longitudinal axis and within the body; and a toroidal ring electrode proximate a distal end of the connector and embedded within the body, wherein the toroidal ring electrode includes an elliptical cross-section, and wherein material of the body surrounds and contacts an outer surface of the toroidal ring electrode.

2. The apparatus as defined in claim 1, wherein the toroidal ring electrode is electrically coupled to the electrical conductor.

3. The apparatus as defined in claim 1, wherein the electrical conductor is a first electrical conductor, and further including a second electrical conductor that is electrically coupled to the toroidal ring electrode, the second electrical conductor corresponding to a respective mating connector.

4. The apparatus as defined in claim 3, wherein the first electrical conductor is electrically coupled to the second electrical conductor.

5. The apparatus as defined in claim 1, wherein the toroidal ring electrode is molded or cast within the body.

6. The apparatus as defined in claim 1, further including a grounding cone embedded within the body.

7. A method comprising:

applying a voltage to at least one of first and second connectors that are matably coupled, the first connector including a connector body, wherein a toroidal ring electrode located proximate a distal end of the first connector is embedded within the connector body, wherein the toroidal ring electrode includes an elliptical cross-section, and wherein material of the body surrounds and contacts an outer surface of the toroidal ring electrode.

8. The apparatus as defined in claim 1, wherein the material of the body includes a potting material that surrounds the outer surface of the toroidal ring electrode.

9. A method of producing a connector, the method comprising:

placing an electrical conductor within a body of the connector, the electrical conductor to extend along a longitudinal length of the body; and defining a toroidal ring electrode to be embedded within the body, the toroidal ring electrode to be located proximate a distal end of the connector, wherein the toroidal ring electrode includes an elliptical cross-section, and wherein material of the body is to surround and contact an outer surface of the toroidal ring electrode.

10. The method as defined in claim 9, wherein the electrical conductor is a first conductor and, further including coupling a second electrical conductor to the toroidal ring electrode, the second electrical conductor corresponding to a respective mating connector.

11. The method as defined in claim 9, further including coupling the electrical conductor to the toroidal ring electrode.

12. The method as defined in claim 9, further including coupling a ground cone to the body, the ground cone to be at least partially disposed within the body.

13. The method as defined in claim 9, further including providing a potting material to at least partially surround the toroidal ring electrode.

14. The method as defined in claim 9, wherein defining the toroidal ring electrode within or surrounding the body includes molding or over-molding the body around at least a portion of the toroidal ring electrode.

15. The method as defined in claim 9, wherein defining the toroidal ring within or surrounding the body includes molding or casting the toroidal ring electrode within the body.

16. An apparatus comprising:

a body of a connector, the body having an electrical conductor extending along a longitudinal axis of the body; and a toroidal ring electrode embedded within an outer surface of the body and proximate a distal end of the connector, wherein the toroidal ring electrode includes an elliptical cross-section, and wherein material of the body surrounds and contacts an outer surface of the toroidal ring electrode.

17. The method as defined in claim 7, wherein applying the voltage includes applying the voltage to the toroidal ring electrode.

18. The apparatus as defined in claim 16, further including an electrical coupling of the connector extending between the electrical conductor and the toroidal ring electrode.

19. The apparatus as defined in claim 18, wherein the electrical coupling extends external to the body.

20. The method as defined in claim 17, wherein the toroidal ring electrode is electrically isolated from the second connector.

21. The apparatus as defined in claim 16, wherein the connector is a first connector, and further including a second connector matably couplable to the first connector.

22. The apparatus as defined in claim 21, further including a contact of the second connector to be electrically coupled to the toroidal ring electrode when the second connector is coupled to the first connector.

23. The method as defined in claim 17, wherein the toroidal ring electrode is electrically isolated from the first connector.

24. The apparatus as defined in claim 1, wherein at least a portion of the electrical conductor extends along a lateral direction of the body to contact the toroidal ring electrode.

25. The method as defined in claim 7, further including coupling the first and second connectors together.

* * * * *